US006959460B2

(12) United States Patent
Patterson

(10) Patent No.: US 6,959,460 B2
(45) Date of Patent: Nov. 1, 2005

(54) PORTABLE WASH BASIN DEVICE

(76) Inventor: Scott Patterson, 1502 11th St., Monroe, WI (US) 53566

( * ) Notice: Subject to any disclaimer, the term of this patent is extended or adjusted under 35 U.S.C. 154(b) by 0 days.

(21) Appl. No.: 10/354,321

(22) Filed: Jan. 30, 2003

(65) Prior Publication Data

US 2004/0148697 A1 Aug. 5, 2004

(51) Int. Cl.[7] ..... A47K 1/00
(52) U.S. Cl. ..... 4/625
(58) Field of Search ..... 4/625

(56) References Cited

U.S. PATENT DOCUMENTS 2,594,938 A * 4/1952 Leavitt ..... 4/626
3,453,665 A * 7/1969 Hager et al. ..... 4/625
5,301,376 A * 4/1994 Herbert ..... 4/626
5,526,539 A * 6/1996 Bower et al. ..... 4/516

* cited by examiner

*Primary Examiner*—Charles E. Phillips
(74) *Attorney, Agent, or Firm*—David J. Archer

(57) ABSTRACT

A portable wash basin device is disclosed. The device includes a sink for receiving fresh water therein for permitting a user thereof to wash. The sink defines an open top for the reception therein of the fresh water so that the user thereof is permitted to wash therein. A container is disposed adjacent to the sink for containing the fresh water and a pump is operably connected to the container for pumping the fresh water from the container into the sink. A lid is secured to the sink such that when the lid is disposed in an open disposition thereof, access to the sink by the user thereof is permitted and when the lid is disposed in a closed disposition thereof, the lid covers the sink.

8 Claims, 13 Drawing Sheets

PORTABLE WASH BASIN DEVICE

BACKGROUND OF THE INVENTION

1. Field of the Invention

The present invention relates to a portable wash basin device. More particularly, the present invention relates to a portable wash basin device which includes a sink for receiving fresh water for permitting a user thereof to wash therein.

2. Background Information

Many homes have more occupants than bathrooms and, especially with children, there would be a benefit to having a portable personal sink for each child for personal use at the child's dresser or private room. Having the provision to brush teeth anywhere can be an incentive to improve dental health habits. Such is the case particularly if the device has a connection to the child's interest such as cartoon character features.

Also, when camping in remote areas, washing facilities with running water are often few and far between. Accordingly, the present invention provides a compact and portable washing facility that permits the user thereof to wash therein. Also, the present invention provides a sink that can be filled with fresh water for cleaning the user's teeth. Furthermore, the present invention provides a device in which waste water from the washing procedure can be stored for later disposal thereof.

While recreational vehicles and campers are fitted with sinks and pumps for supplying fresh water for washing, campers with tents do not have such plumbing facilities and must rely on the provision of such washing facilities at recognized campsites. However, in wilderness regions and remote camping grounds, such washrooms are often not provided.

Furthermore, many people could be persuaded to keep better dental hygiene if they had a way to brush effectively anywhere including in the office, on the road and at the job site.

A variation of the present invention is directed at the working person who wants a way to brush after a noon meal without having to find a bathroom. The apparatus, according to the present invention allows the ability to brush anywhere and at any time.

Therefore, it is a primary feature of the present invention to provide a portable wash basin device that overcomes the problems associated with the prior art arrangements.

Another feature of the present invention is the provision of a portable wash basin device that enables the user thereof to wash and to attend to personal hygiene such as brushing teeth.

Other features and advantages of the present invention will be readily apparent to those skilled in the art by a consideration of the detailed description of a preferred embodiment of the present invention contained herein.

SUMMARY OF THE INVENTION

The present invention relates to a portable wash basin device. The device includes a sink for receiving fresh water therein for permitting a user thereof to wash. The sink defines an open top for the reception therein of the fresh water so that the user thereof is permitted to wash therein. A container is disposed adjacent to the sink for containing fresh water and a pump is operably connected to the container for pumping the fresh water from the container into the sink. A lid is secured to the sink such that when the lid is disposed in an open disposition, access to the sink by the user thereof is permitted and when the lid is disposed in a closed disposition thereof, the lid covers the sink.

In a more specific embodiment of the present invention, the sink defines a drain for draining waste water from the sink.

The portable wash basin device further includes a plug which cooperates with the drain such that when the plug is disposed in a first location, a flow of water through the drain is inhibited and when the plug is disposed in a second location thereof, waste water within the sink is permitted to flow from the sink through the drain.

Additionally, the portable wash basin device also includes a receptacle which is disposed in fluid communication with the drain for collecting therein the waste water flowing from the sink through the drain.

Moreover, the container is disposed between the sink and the receptacle and the pump is secured to the sink for pumping the fresh water from the container into the sink.

In another embodiment of the present invention, the pump includes a bellows arrangement having a first and a second end. The first end of the bellows arrangement defines a hand actuator. A first one way valve is sealingly connected to the bellows arrangement such that when the hand actuator is depressed, fresh water within the bellows arrangement is expressed from the bellows arrangement through the first one way valve. Also, a second one way valve is sealingly connected to the bellows arrangement such that when the hand actuator is released, fresh water flows from the container through the second one way valve into the bellows arrangement.

In a further embodiment of the present invention, the pump includes a cylinder which is operably connected to the container. A compression spring is disposed within the cylinder, the spring having a first and a second extremity. A threaded spindle extends through and is disposed coaxially relative to the spring and cylinder, the spindle having a first and a second end. A handle is secured to the first end of the spindle and a washer threadably cooperates with the spindle and is disposed between the handle and the first extremity of the spring. The arrangement is such that when the handle is rotated, the washer is urged against the first extremity of the spring for compressing the spring. A piston is disposed within the cylinder adjacent to the second extremity of the spring so that when the spring is compressed, the piston is urged axially along the cylinder for pumping fresh water from the container to the sink.

In one embodiment of the present invention, the portable wash basin includes a rinse wand which is connected to the container. The wand includes a flexible tube which has a first and a second termination. A connector is attached to the first termination of the tube for sealingly connecting the wand to the container so that when the pump is actuated, fresh water flows from the container through the connector and the tube. An application nozzle is secured to the second termination of the flexible tube such that fresh water flows from the tube through the nozzle. More particularly, the nozzle is a tooth brush.

Moreover, in one embodiment of the present invention, a faucet removably cooperates with the container and a flexible conduit extends from the pump to the faucet so that when the pump is actuated, fresh water flows from the container through the pump and conduit to the faucet where the fresh water is dispensed.

Additionally, a control valve is provided for controlling the flow of the fresh water flowing from the pump through the conduit.

Furthermore, the lid defines a seal which cooperates with the sink when the lid is disposed in the closed disposition thereof for sealing waste water within the sink.

Also, a mirror is secured to the lid such that when the lid is disposed in the open disposition thereof, use of the mirror by the user is permitted.

In another variation of the present invention, a portable wash basin device includes a sink for receiving fresh water therein for permitting a user thereof to wash a toothbrush. The sink defines an open top for the reception therein of the fresh water so that the user thereof is permitted to wash the toothbrush therein. A container is disposed adjacent to the sink for containing fresh water and a lid is secured to the sink such that when the lid is disposed in an open disposition, access to the sink by the user thereof is permitted and when the lid is disposed in a closed disposition thereof, the lid covers the sink. Additionally, a toothbrush holder is attached to the sink. This variation is directed at people at work who want a convenient way to maintain good dental hygiene after meals. While at work, the user can brush teeth anywhere such as at the office or at the job site.

The portable wash basin device further includes a disposable liner which is disposed within the sink.

Furthermore, the container is a bottle which is removably fastened to the sink.

The lid threadably cooperates with the sink for selectively sealing the open top of the sink and the toothbrush holder is removably attached to the sink.

In one variation according to the present invention, the toothbrush holder is integrally molded with the container and the toothbrush holder includes a vent in order to permit air drying of the toothbrush. A sealed lid cooperates with the toothbrush holder for retaining the toothbrush within the toothbrush holder. Additionally, a squeeze type bottle is removably disposed within the container for containing fresh water so that when the sink is to receive fresh water therein, the user removes the bottle from the container and dispenses fresh water therefrom into the sink.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views and embodiments of the drawings.

DETAILED DESCRIPTION OF THE DRAWINGS

Figure 1:
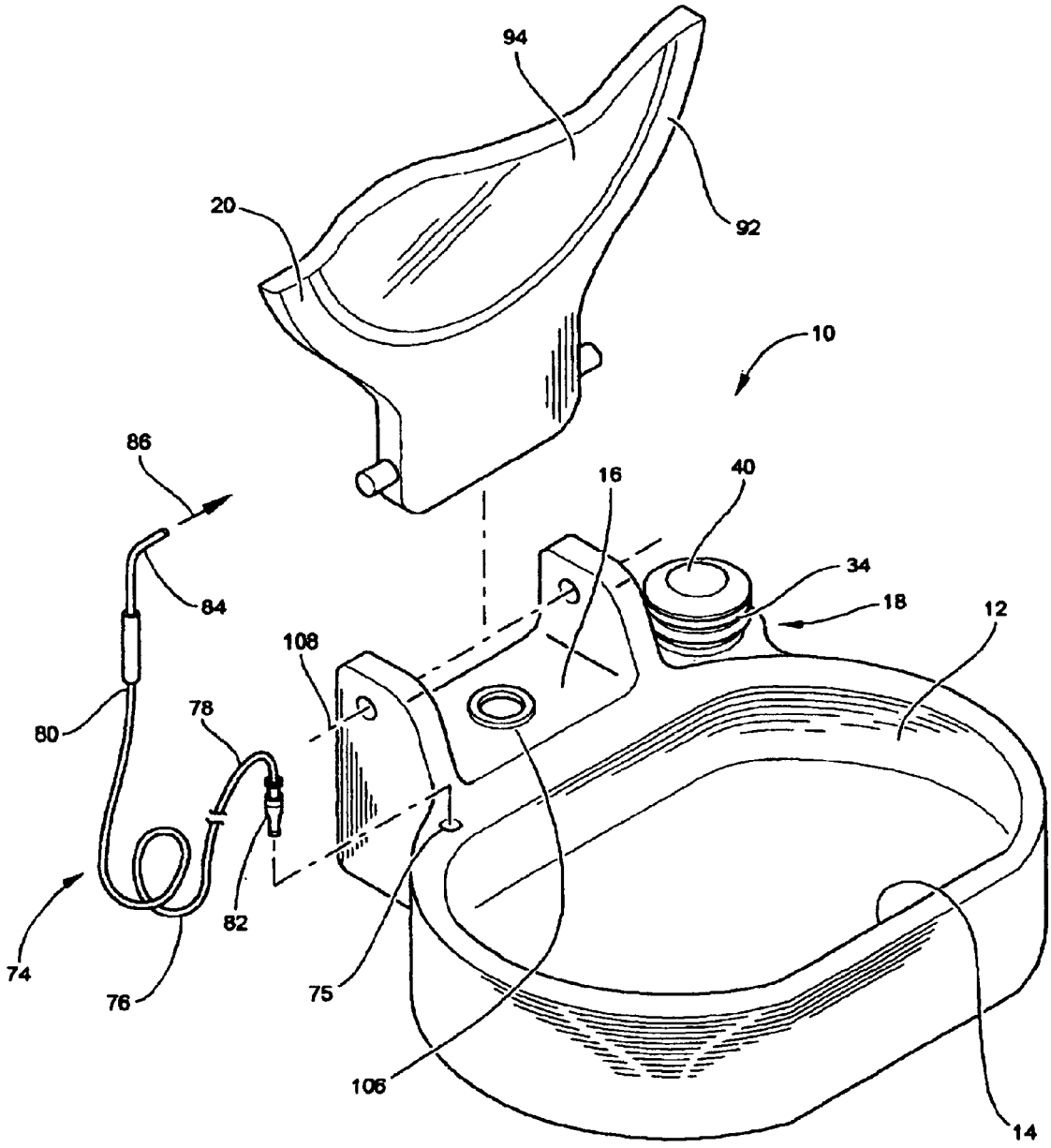
FIG. 1 is a perspective view of a portable wash basin device according to the present invention.

FIG. 1 is a perspective view of a portable wash basin device generally designated 10 according to the present invention. As shown in FIG. 1, the device 10 includes a sink 12 for receiving fresh water therein for permitting a user thereof to wash. The sink 12 defines an open top 14 for the reception therein of the fresh water so that the user thereof is permitted to wash therein. A container 16 is disposed adjacent to the sink 12 for containing fresh water and a pump generally designated 18 is operably connected to the container 16 for pumping the fresh water from the container 16 into the sink 12. A lid 20 is secured to the sink 12 such that when the lid 20 is disposed in an open disposition thereof as shown in FIG. 1, access to the sink 12 by the user is permitted and when the lid is disposed in a closed disposition thereof, the lid 20 covers the sink 12.

Figure 2:
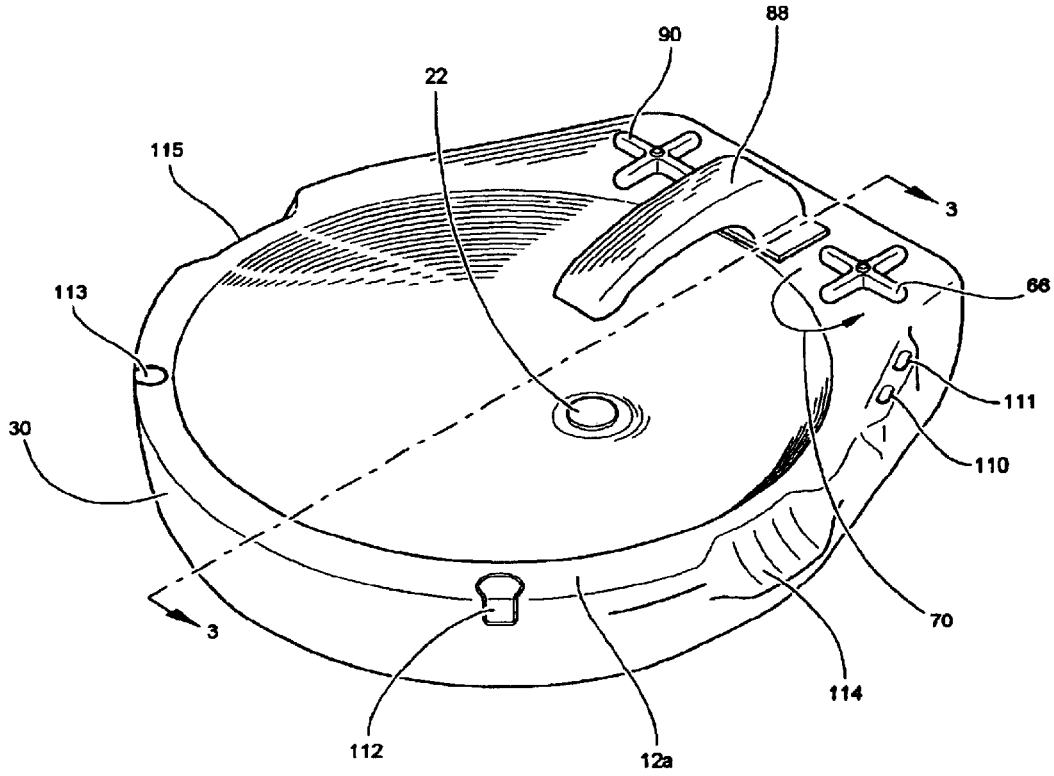
FIG. 2 is a perspective view of an alternative embodiment of the present invention.

FIG. 2 is a perspective view of an alternative embodiment of the present invention. As shown in FIG. 2, a sink 12*a* defines a drain 22 for draining waste water from the sink 12*a*.

Figure 3:
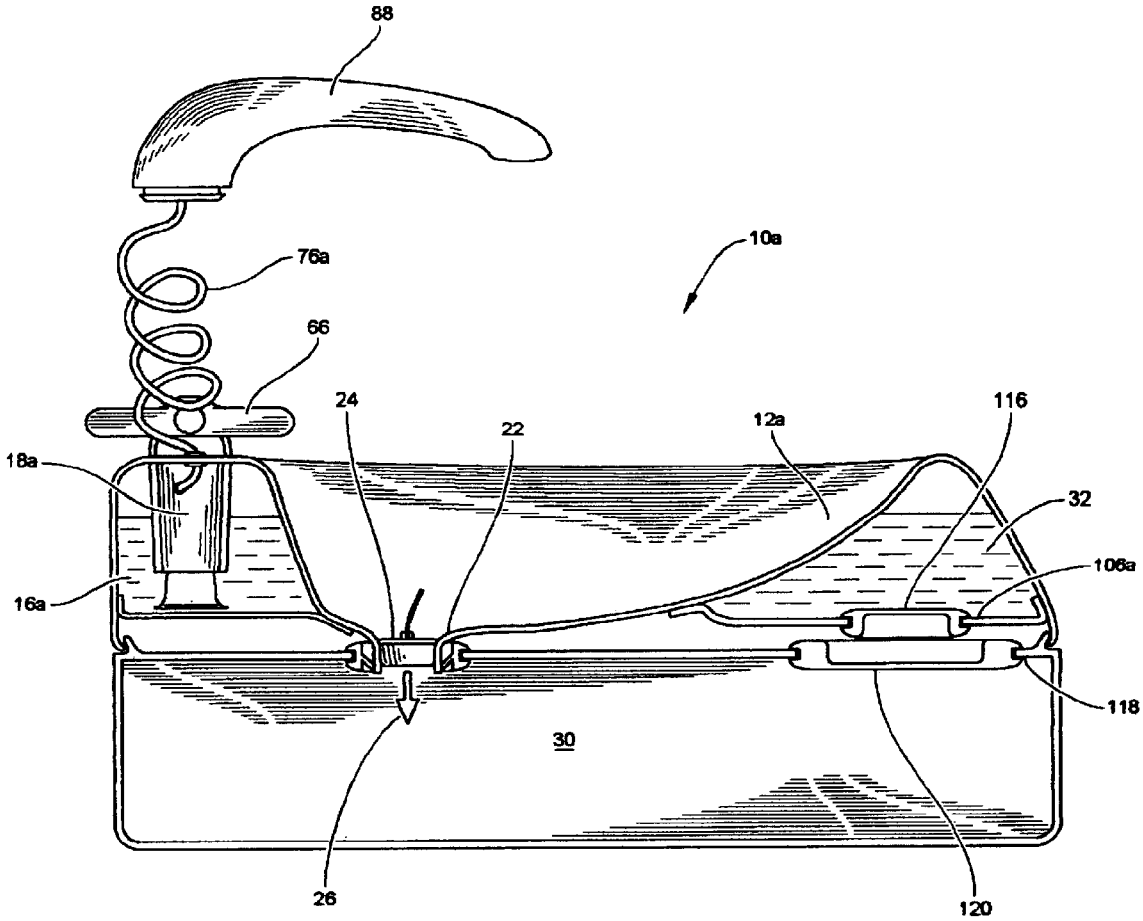
FIG. 3 is a sectional view taken on the line 3—3 of FIG. 2.

FIG. 3 is a sectional view taken on the line 3—3 of FIG. 2. As shown in FIG. 3, the portable wash basin device 10*a* further includes a plug 24 which cooperates with the drain 22 such that when the plug 24 is disposed in a first location thereof as shown in FIG. 3, a flow of water, as indicated by the arrow 26, is inhibited.

Figure 4:
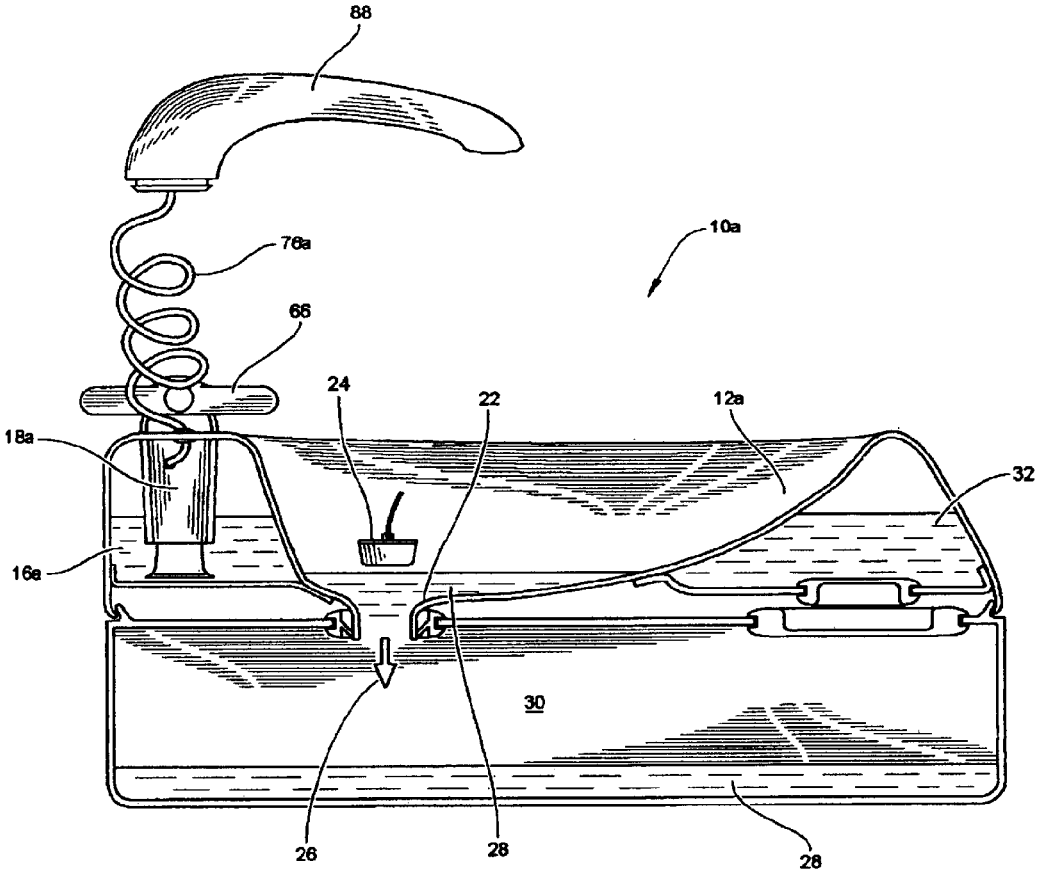
FIG. 4 is a similar view to that shown in FIG. 3 showing the plug disposed in a second location thereof.

FIG. 4 is a similar view to that shown in FIG. 3. However, as shown in FIG. 4, when the plug 24 is disposed in a second location thereof, waste water 28 within the sink 12*a* is permitted to flow as indicated by the arrow 26, from the sink 12*a* through the drain 22.

The portable wash basin device 10*a* also includes a receptacle 30 which is disposed in fluid communication with the drain 22 for collecting therein the waste water 28 flowing from the sink 12*a* through the drain 22.

A container 16*a* is disposed between the sink 12*a* and the receptacle 30 and a pump 18*a* is secured to the sink 12*a* for pumping fresh water 32 from the container 16*a* into the sink 12*a*.

In the embodiment according to the present invention as shown in FIG. 1, the pump 18 includes a bellows arrangement 34.

Figure 5:
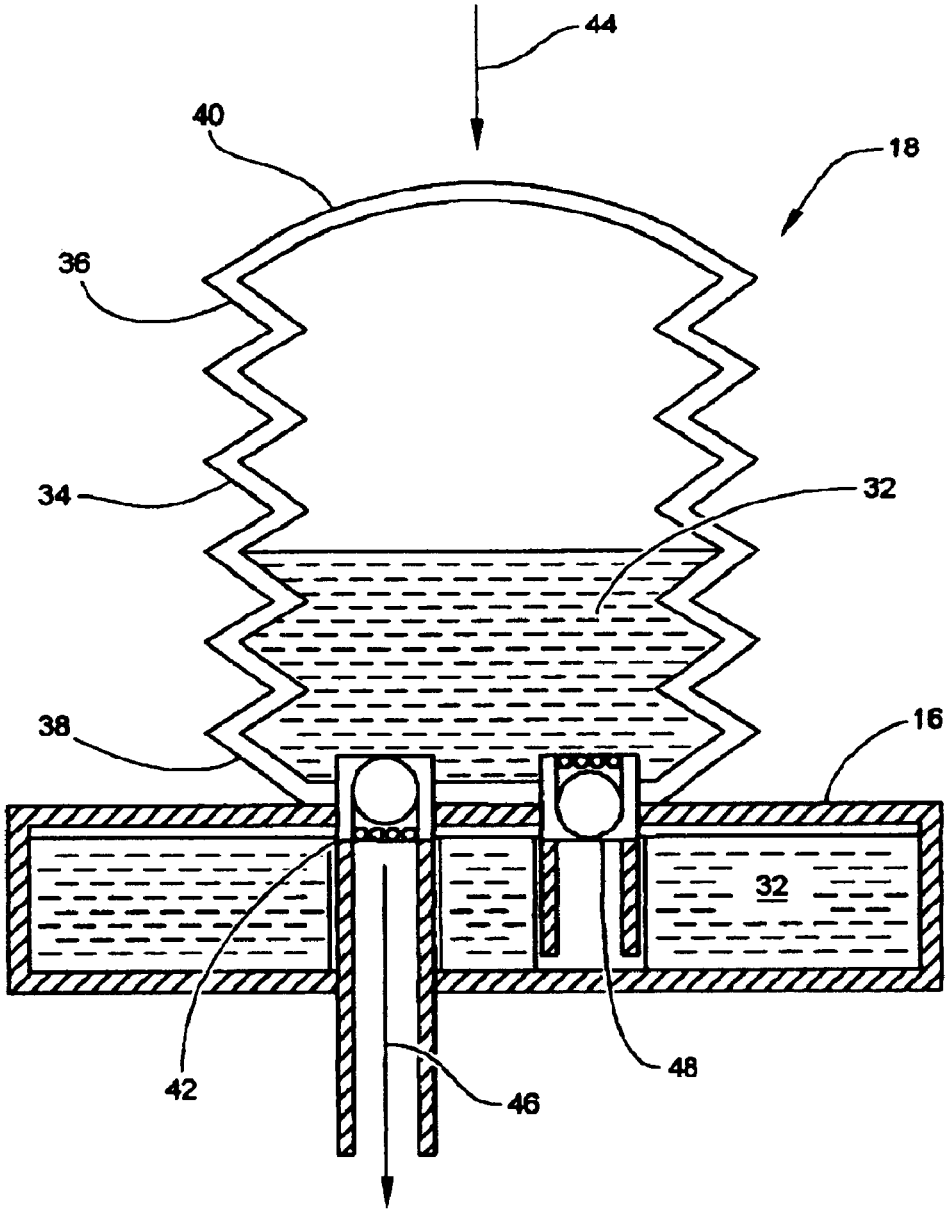
FIG. 5 is an enlarged sectional view of a pump shown in FIG. 1.

FIG. 5 is an enlarged sectional view of the pump 18. As shown in FIG. 5, the bellows arrangement 34 has a first and a second end 36 and 38 respectively. The first end 36 of the bellows arrangement 34 defines a hand actuator 40. A first one way valve 42 is sealingly connected to the bellows arrangement 34 such that when the hand actuator 40 is depressed as indicated by the arrow 44, fresh water 32 within the bellows arrangement 34 is expressed as indicated by the arrow 46 from the bellows arrangement 34 through the first one way valve 42.

Figure 6:
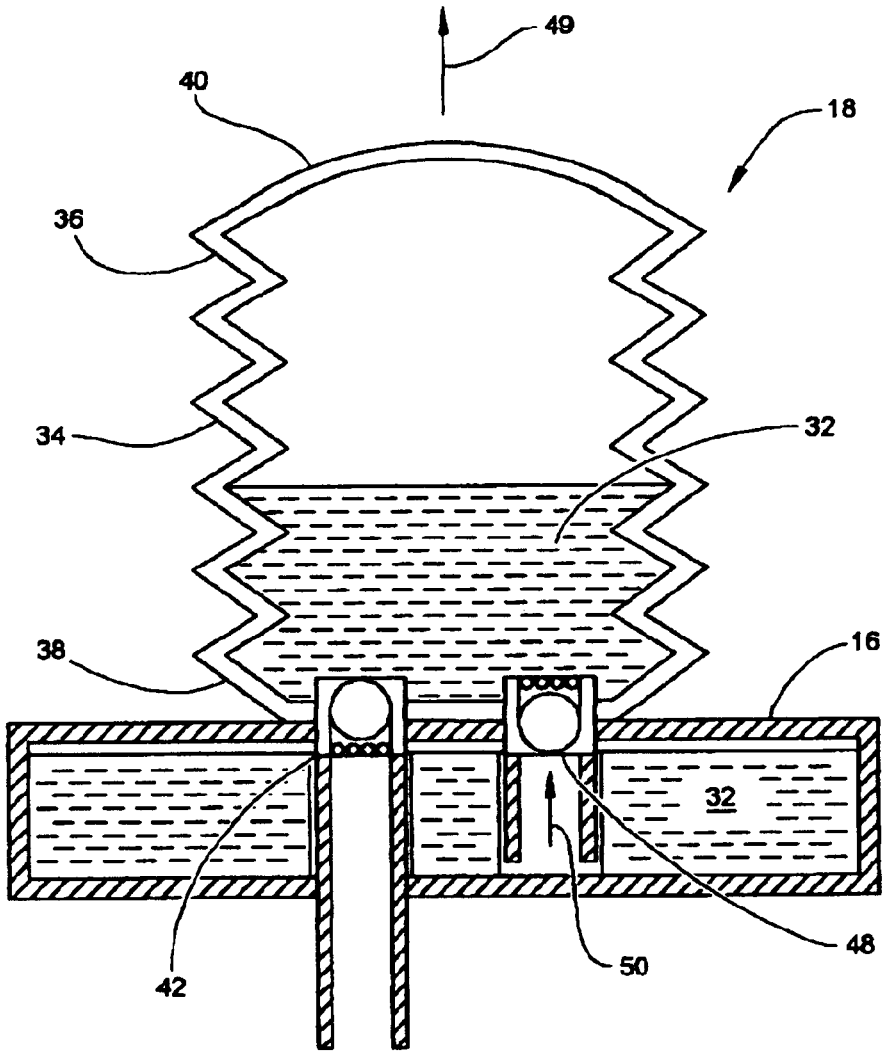
FIG. 6 is a similar view to that shown in FIG. 5 but shows the pump released.

FIG. 6 is a similar view to that shown in FIG. 5 but shows the pump 18 released. As shown in FIG. 6, a second one way valve 48 is sealingly connected to the bellows arrangement 34 such that when the hand actuator 40 is released as indicated by the arrow 49, fresh water 32 flows as indicated by the arrow 50, from the container 16 through the second one way valve 48 into the bellows arrangement 34.

Figure 7:
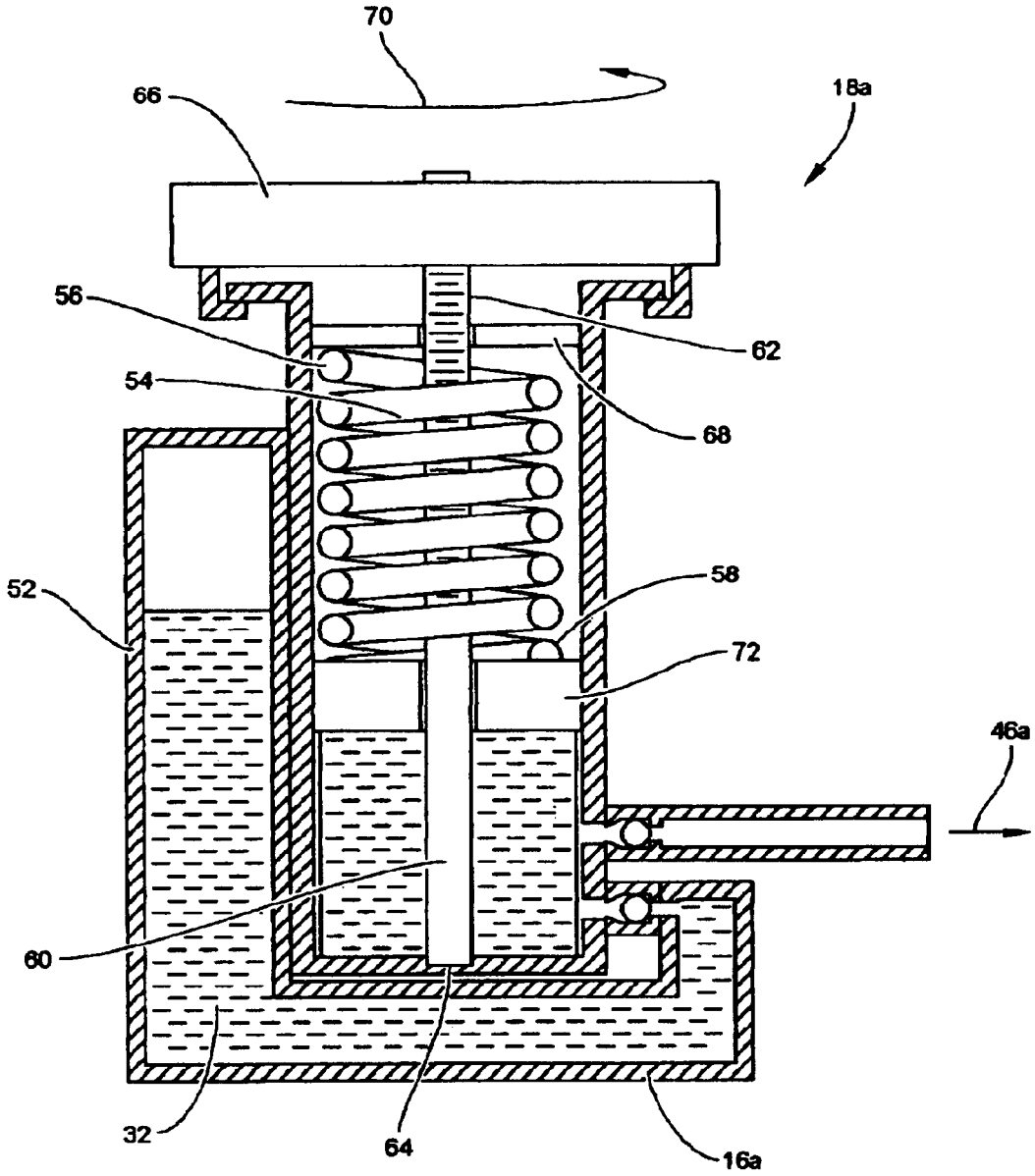
FIG. 7 is an enlarged sectional view of an alternative type of pump as shown in FIGS. 2–4.

FIG. 7 is an enlarged sectional view of an alternative type of pump as shown in FIGS. 2–4. As shown in FIG. 7, a pump 18*a* includes a cylinder 52 which is operably connected to the container 16*a*. A compression spring 54 is disposed within the cylinder 52, the spring 54 having a first and a second extremity 56 and 58 respectively. A threaded spindle 60 extends through and is disposed coaxially relative to the spring 54 and cylinder 52, the spindle 60 having a first and a second end 62 and 64 respectively. A handle 66 is secured to the first end 62 of the spindle 60 and a washer 68 threadably cooperates with the spindle 60 and is disposed between the handle 66 and the first extremity 56 of the spring 54. The washer 68 is guided by the cylinder 52 so that when the handle 66 is rotated, the washer is permitted to move axially but not rotationally relative to the cylinder 52. The arrangement is such that when the handle 66 is rotated as indicated by the arrow 70 shown in FIG. 2, the washer 68 is urged against the first extremity 56 of the spring 54 for compressing the spring 54. A piston 72 is disposed within the cylinder 52 adjacent to the second extremity 58 of the spring 54 so that when the spring 54 is compressed, the piston 72 is urged axially along the cylinder 52 for pumping fresh water 32 as indicated by the arrow 46*a*, from the container 16*a* to the sink 12*a*.

In the embodiment of the present invention shown in FIG. 1, the portable wash basin 10 includes a rinse wand generally designated 74 which is detachably connected to an orifice 75 defined by the container 16. The wand 74 includes a flexible tube 76 which has a first and a second termination 78 and 80 respectively. A connector 82 is attached to the first termination 78 of the tube 76 for sealingly connecting the wand 74 to the orifice 75 of the container 16 so that when the pump 18 is actuated, fresh water 32 flows from the container 16 through the connector 82 and the tube 76. An application nozzle 84 is secured to the second termination 80 of the flexible tube 76 such that fresh water 32 flows as indicated by the arrow 86, from the tube 76 through the nozzle 84. More particularly, the nozzle 84 is a hollow type tooth brush.

Moreover, in the embodiment shown in FIGS. 2–4, a faucet 88 removably cooperates with the container 16*a* and a flexible conduit 76*a* extends from the pump 18*a* to the faucet 88 so that when the pump 18*a* is actuated, fresh water 32 flows from the container 16*a* through the pump 18*a* and conduit 76*a* to the faucet 88 where the fresh water is dispensed.

Additionally, a control valve 90 is provided for controlling the flow of the fresh water 32 flowing from the pump 18*a* through the conduit 76*a*.

Furthermore, in the embodiment shown in FIG. 1, the lid 20 defines a seal 92 which cooperates with the sink 12 when the lid 20 is disposed in the closed disposition thereof for sealing waste water within the sink 12.

Also, a mirror 94 is secured to the lid 20 such that when the lid 20 is disposed in the open disposition thereof as shown in FIG. 1, use of the mirror 94 by the user is permitted.

Figure 8:
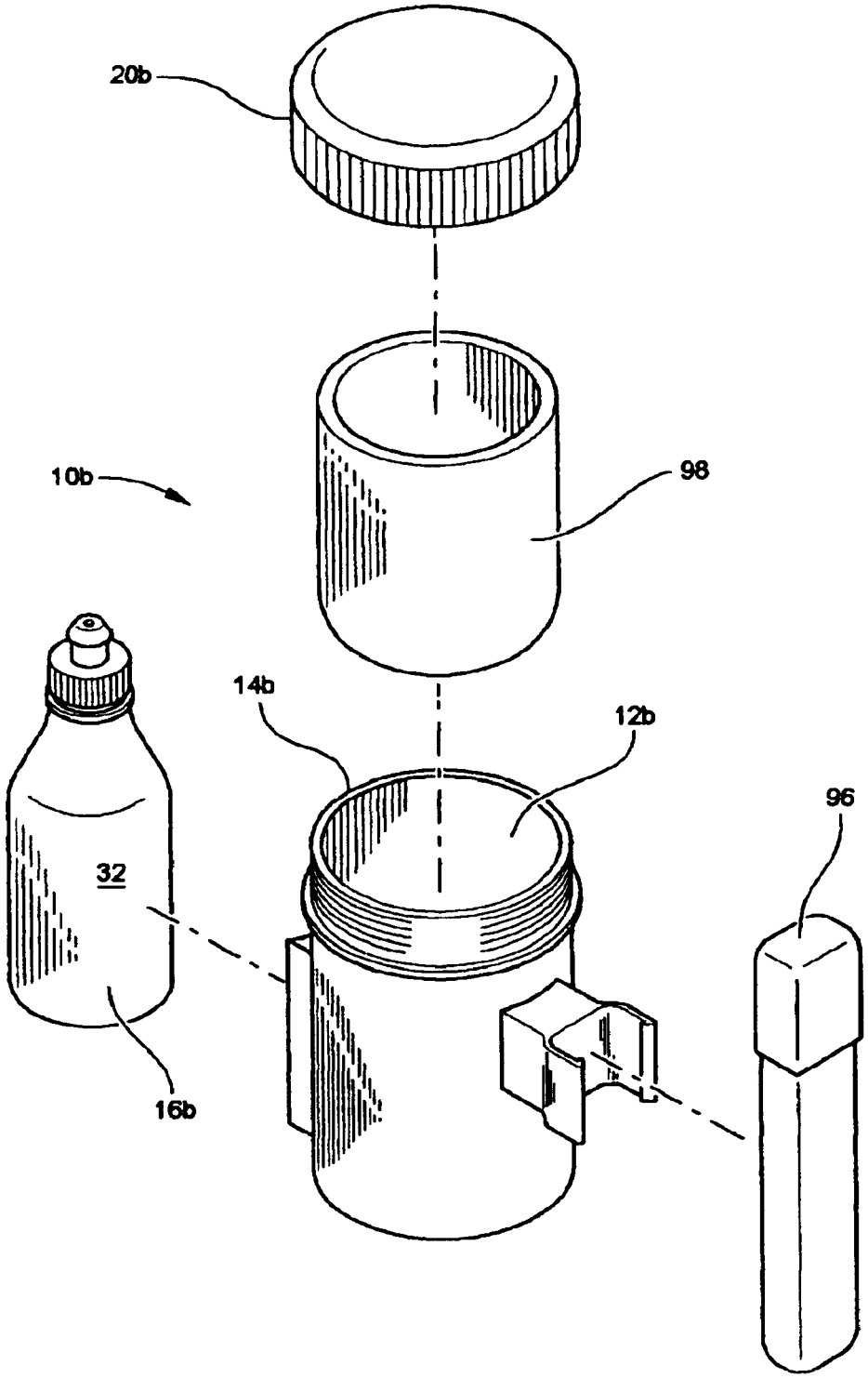
FIG. 8 is a perspective view of another variation according to the present invention.

FIG. 8 is an exploded perspective view of another variation according to the present invention. As shown in FIG. 8, a portable wash basin device 10*b* includes a sink 12*b* for receiving fresh water therein for permitting a user thereof to wash a toothbrush (not shown). The sink 12*b* defines an open top 14*b* for the reception therein of fresh water so that the user thereof is permitted to wash the toothbrush therein. A container 16*b* is disposed adjacent to the sink 12*b* for containing fresh water 32 and a lid 20*b* is secured to the sink 12*b* such that when the lid 20*b* is disposed in an open disposition thereof as shown in FIG. 8, access to the sink 12*b* by the user thereof is permitted and when the lid 20*b* is disposed in a closed disposition thereof, the lid 20*b* covers the sink 12*b*.

Additionally, a toothbrush holder 96 is attached to the sink 12*b*.

The portable wash basin device 10*b* further includes a disposable liner 98 which is disposed within the sink 12*b*.

Furthermore, the container 16*b* is a bottle which is removably fastened to the sink 12*b*.

The lid 20*b* threadably cooperates with the sink 12*b* for selectively sealing the open top 14*b* of the sink 12*b* and the toothbrush holder 96 is removably attached to the sink 12*b*.

Figure 9:
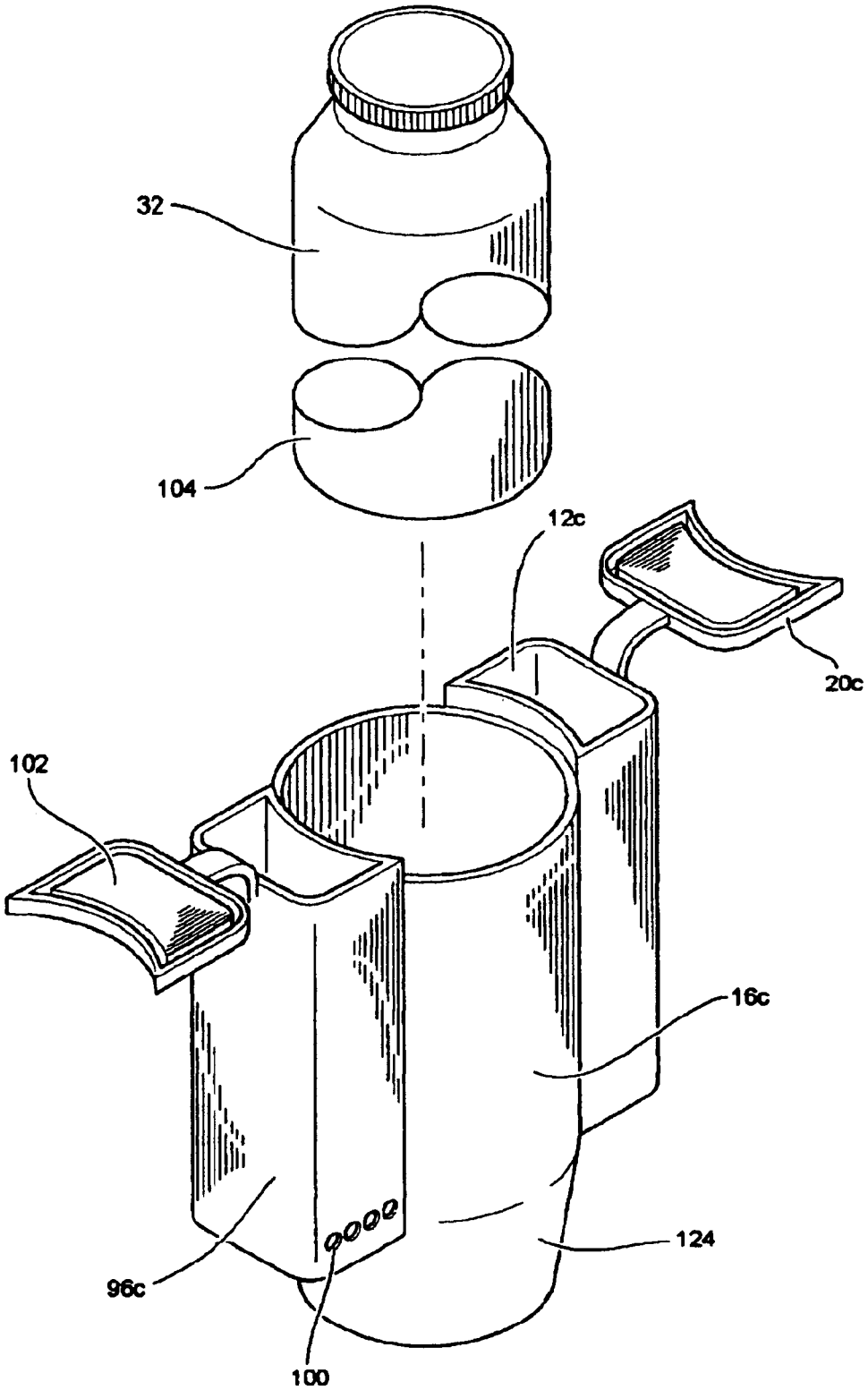
FIG. 9 is a perspective view of a further variation according to the present invention.

FIG. 9 is a perspective view of a further variation according to the present invention. As shown in FIG. 9, a toothbrush holder 96*c* is integrally molded with a container 16*c* and the toothbrush holder 96*c* includes a vent 100 in order to permit air drying of the toothbrush (not shown). A sealed lid 102 cooperates with the toothbrush holder 96*c* for retaining the toothbrush within the toothbrush holder 96*c*. Additionally, a squeeze type bottle 104 is removably disposed within the container 16*c* for containing fresh water 32 so that when a sink 12*c* is to receive fresh water 32 therein, the user removes the bottle 104 from the container 16*c* and dispenses fresh water 32 therefrom into the sink 12*c*.

Additionally, as shown in FIG. 1, the container 16 includes a filling port 106 which may be threaded or shaped to sealably or threadably receive therein a neck of a bottle containing fresh water in order to replenish the container 16. Also as shown in FIG. 1, the lid 20 is pivotally secured about axis 108, to the back of the sink 12.

In the arrangement shown in FIGS. 2–4, the sink 12*a* may define apertures 110 and 111 for the placement therein of toothbrushes (not shown). The sink 12*a* may also be provided with latches 112 and 113 for securing the receptacle 30 to the sink 12*a*. Also, a lifting handle 114 and 115 are provided.

As shown in FIGS. 3 and 4, the container 16*a* is provided with a filling port 106*a* with a sealing plug 116. Similarly, the receptacle 30 is provided with a drainage port 118 and cooperating closure 120.

Figure 10:
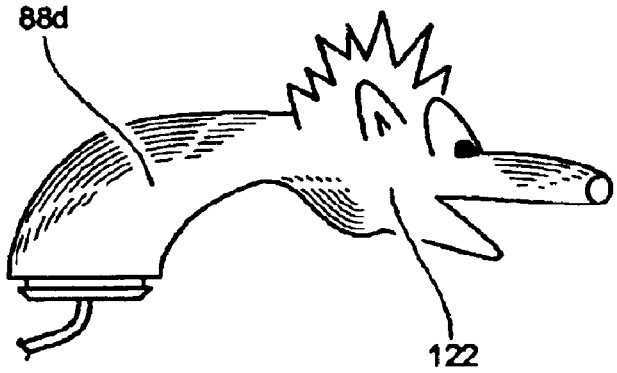
FIG. 10 is a side elevational view of an alternative type of faucet to that shown in FIG. 2.

FIG. 10 is a side elevational view of an alternative type of faucet 88*d* having an outlet 122 in the shape of a cartoon character.

In the embodiment shown in FIG. 9, the sink 12*c* is provided with a watertight lid 20*c*. Also, the sink 12*c* may be provided with a plastic liner, a zip lock type bag or the like for the reception therein of fresh water and waste water subsequent to a teeth cleaning operation. Additionally, the base 124 of the container 16*c* may be shaped in order to be removably received within an opening of a cup dispenser (not shown). Also, the toothbrush (not shown) may be of the type having toothpaste already applied thereto and may be of the disposable type.

Figure 11:
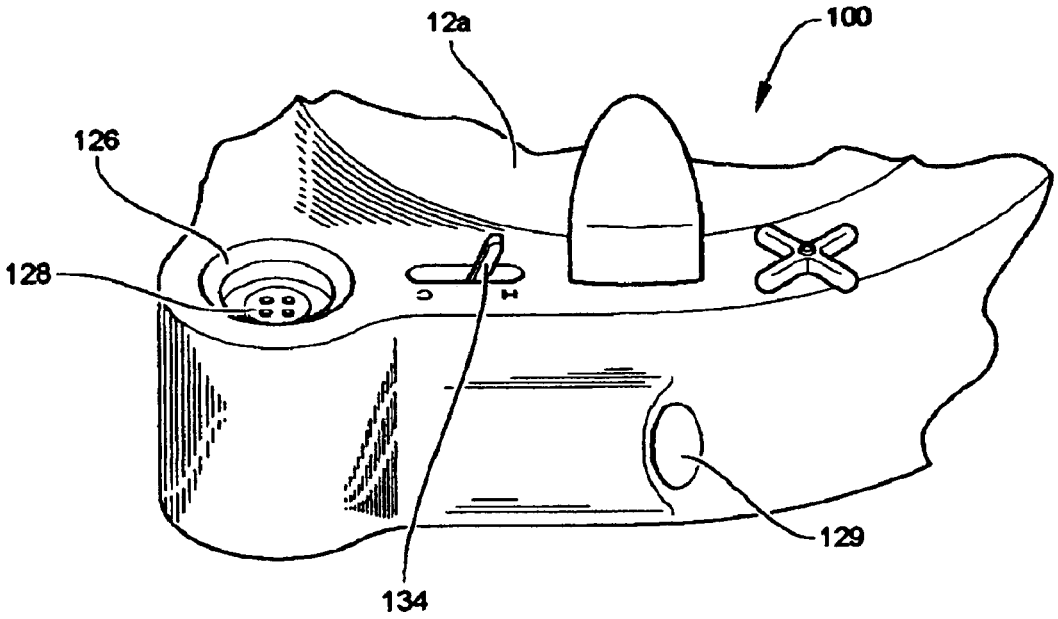
FIG. 11 is a perspective view of a further embodiment of the present invention.

FIG. 11 is a perspective view of a further embodiment of the present invention. As shown in FIG. 11, a portable wash basin device generally designated 10*e* includes a heater generally designated 126 for heating fresh water flowing from a container to the sink 12*e*.

Figure 12:
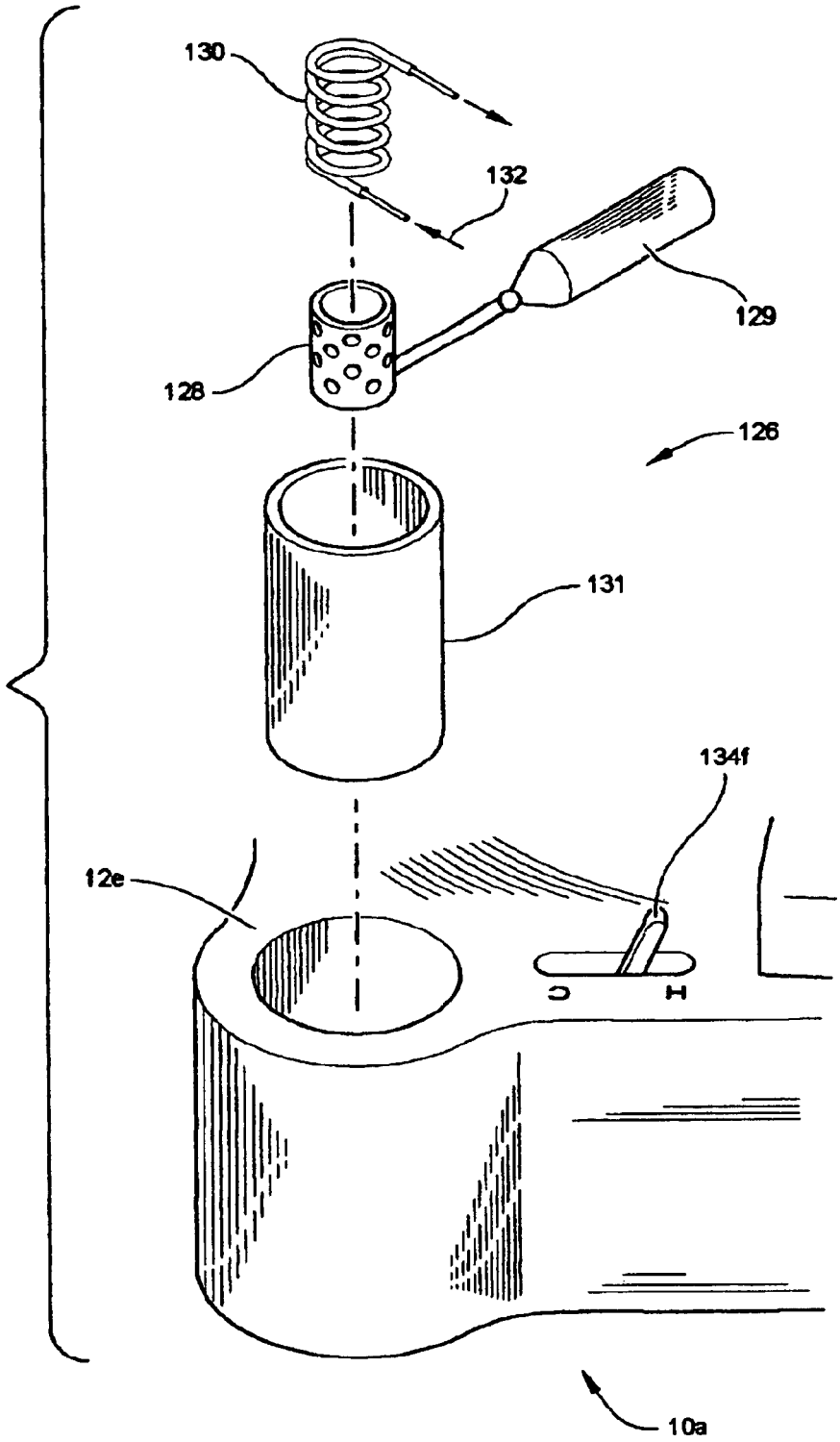
FIG. 12 is an exploded view of the heater shown in FIG. 11.

FIG. 12 is an exploded view of the heater 126 shown in FIG. 11. The heater 126 includes a gas burner 128 connected to a gas cylinder 129 such as a Butane bottle. The heater 126 also includes a heating coil 130 that is disposed adjacent to the burner 128 for heating a first flow of the fresh water as indicated by the arrow 132 flowing between the container and the sink 12*e*.

Figure 13:
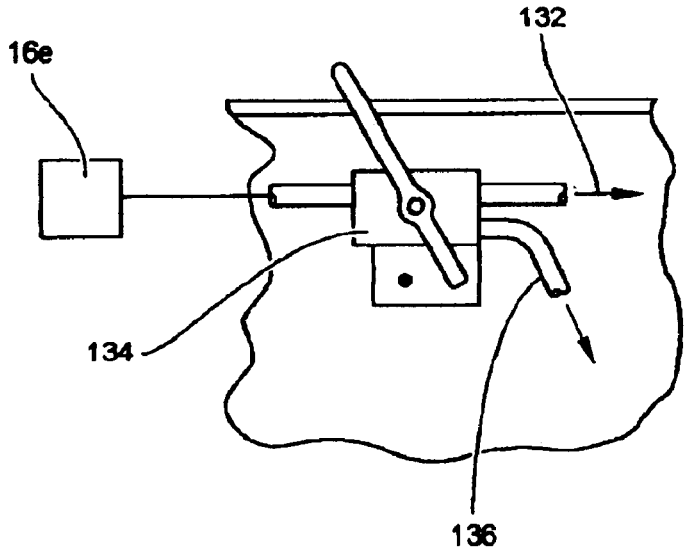
FIG. 13 is an enlarged side elevational view of a regulating valve shown in FIGS. 11 and 12.

FIG. 13 is an enlarged side elevational view of a regulating valve 134 shown in FIGS. 11 and 12 for regulating a second flow of unheated fresh water as indicated by the arrow 136 flowing between the fresh water container 16*e* and the sink 12*e* relative to the first flow 132 such that controlling of a temperature of mixed fresh water flowing to the sink 12*e* is permitted.

Figure 14:
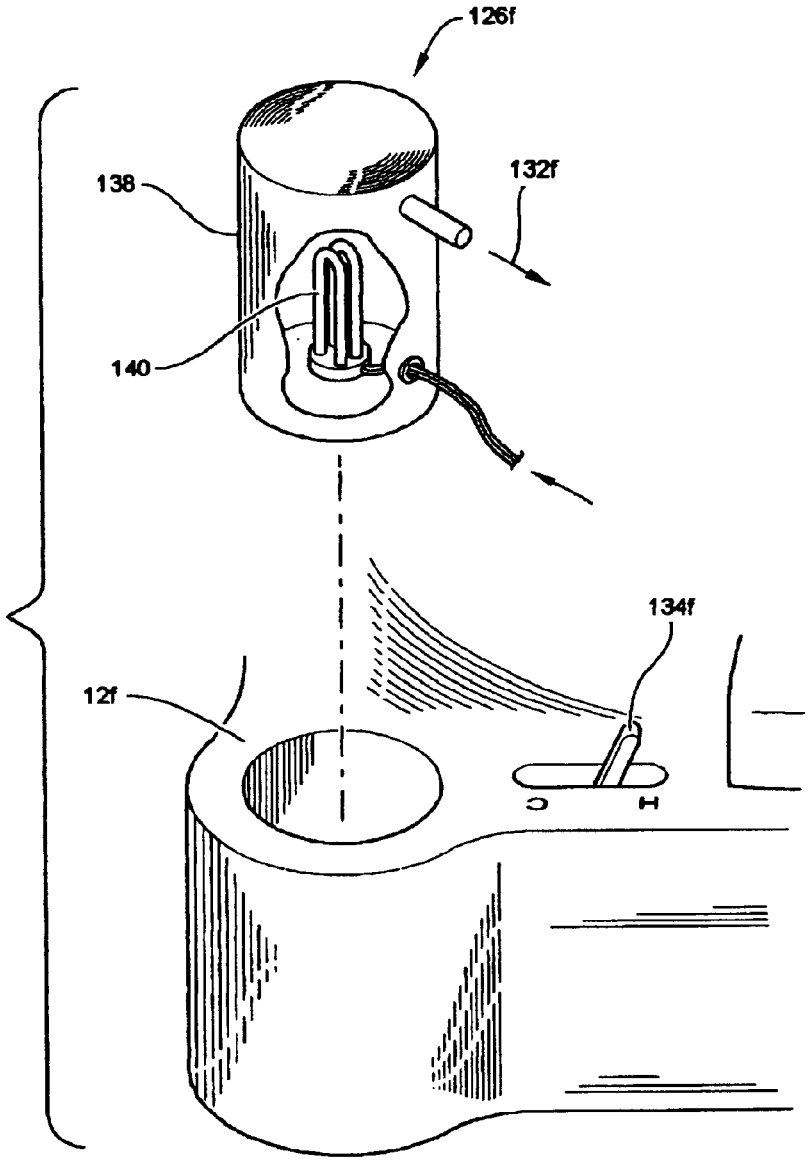
FIG. 14 is an exploded view of yet another embodiment of the present invention.

FIG. 14 is an exploded view of yet another embodiment of the present invention. As shown in FIG. 14, a heater generally designated 126*f* includes a housing 138. An electrical immersion heater 140 is disposed within the housing 138 for heating a first flow of the fresh water as indicated by the arrow 132*f* flowing between a fresh water container and the sink 12*f*. A regulating valve 134*f* is provided for regulating a second flow of unheated fresh water flowing between the container and the sink 12*f* relative to the first flow 132*f*. The arrangement is substantially the same as the arrangement described relative to FIG. 13. The regulating valve 134*f* is provided for controlling a temperature of fresh water flowing to the sink 12*f*.

Those skilled in the art will appreciate that in both the gas burner and the electric heater arrangements, the pump will be disposed in the flow line between the container and the valve. Also, in the case of the gas burner, an igniter is provided for automatically igniting the gas burner when heated water is required. Also, the burner 128 is enclosed in an insulated casing 131 which also provides a venting flue for the burner 128.

In operation of the device, the lid 20 is opened and fresh water is pumped into the sink so that the user can wash. In the arrangement of FIG. 1, when the washing operation has been completed, the user is able to either pour away the waste water or close the lid 20 so as to seal the waste water for later disposal thereof.

However, in the arrangement shown in FIGS. 2–4, the waste water is drained into the receptacle 30 for later disposal.

In the embodiments shown in FIGS. 8 and 9, the user is able to dispense a quantity of fresh water into the sink for cleaning the user's teeth. The waste water is then stored for later disposal thereof.

The present invention provides a compact and portable sink that is useful when camping or where regular plumbing is not available.

What is claimed is:

1. A portable wash basin device, said device comprising:

a sink for receiving fresh water therein for permitting a user thereof to wash, said sink defining an open top for the reception therein of the fresh water so that the user thereof is permitted to wash therein;

a container disposed adjacent to said sink for containing fresh water;

a pump operably connected to said container for pumping the fresh water from said container into said sink;

a receptacle in fluid communication with said sink for receiving therein waste water from said container, said container being disposed between said sink and said receptacle;

a faucet removably cooperating with said container;

a flexible conduit extending from said pump to said faucet so that when said pump is actuated, fresh water flows from said container through said pump and conduit to said faucet where the fresh water is dispensed:

said pump including:

a cylinder operably connected to said container;

a compression spring disposed within said cylinder, said spring having a first and a second extremity;

a threaded spindle extending through and disposed coaxially relative to said spring and cylinder, said spindle having a first and a second end;

a handle secured to said first end of said spindle;

a washer threadably cooperating with said spindle and disposed between said handle and said first extremity of said spring such that when said handle as rotated, said washer is urged against said first extremity of said spring for compressing said spring; and a piston disposed within said cylinder adjacent to said second extremity of said spring, the arrangement being such that when said spring is compressed, said piston is urged axially along said cylinder for pumping fresh water from said container to said sink.

2. A portable wash basin device as set forth in claim 1 wherein said sink defines a drain for draining waste water from said sink.

3. A portable wash basin device as set forth in claim 2 further including:

a plug cooperating with said drain such that when said plug is disposed in a first location thereof, a flow of water through said drain is inhibited and when said plug is disposed in a second location thereof, waste water within said sink is permitted to flow from said sink through said drain.

4. A portable wash basin device as set forth in claim 3 wherein said receptacle is disposed in fluid communication with said drain for collecting therein the waste water flowing from said sink through said drain.

5. A portable wash basin device as set forth in claim 1 further including:

a heater for heating the fresh water flowing from said container to said sink.

6. A portable wash basin device as set forth in claim 1 wherein said pump is secured to said sink for pumping the fresh water from said container into said sink.

7. A portable wash basin device as set forth in claim 1 further including:

a rinse wand connected to said container;

said wand including:

a flexible tube having a first and a second termination;

a connector attached to said first termination of said tube for sealingly connecting said wand to said container so that when said pump is actuated, fresh water flows front said container through said connector and said tube;

an application nozzle secured to said second termination of said flexible tube such that fresh water flows from said tube through said nozzle.

8. A portable wash basin device as set forth in claim 1 further including:

a control valve for controlling a flow of the fresh water flowing from said pump through said conduit.

* * * * *